United States Patent [19]

Harris

[11] Patent Number: 4,840,371

[45] Date of Patent: Jun. 20, 1989

[54] NOVELTY GOLF CLUB WITH PROGRAMMED SOUND PLAYING DEVICE

[76] Inventor: John C. Harris, 310 Sound Beach Ave., Old Greenwich, Conn. 06870

[21] Appl. No.: 124,245

[22] Filed: Nov. 24, 1987

[51] Int. Cl.[4] ..... A63J 5/04; A63J 23/00; A63B 69/36

[52] U.S. Cl. ..... 272/8 N; 273/162 R; 273/183 D; 446/404

[58] Field of Search ..... 273/162 R, 186 A, 119 A, 273/186 R, 186 B, 183 D, 193 R, 194 R, 194 A; 272/8 N, 8 R; 446/404, 397, 405, 408

[56] References Cited

U.S. PATENT DOCUMENTS

| | | | |
|---|---|---|---|
| 2,114,138 | 4/1938 | Corsello | 273/119 A |
| 2,823,037 | 2/1958 | Ferte | 273/162 R |
| 3,655,325 | 4/1972 | Toppel | 434/236 |
| 3,762,720 | 10/1973 | Jett | 273/183 D |
| 4,017,083 | 4/1977 | Johnson | 273/186 A |
| 4,191,378 | 3/1980 | Morin et al. | 273/162 R |
| 4,422,633 | 12/1983 | Petrone | 272/8 N |
| 4,582,317 | 4/1986 | Provenzano | 272/8 N |

*Primary Examiner*—George J. Marlo

*Attorney, Agent, or Firm*—H. Jay Spiegel & Associates

[57] ABSTRACT

Disclosed herein is a novelty golf club including a body made to resemble a golf club having a head, a shaft and a grip. In reality, the head is hollow and contains a sound producing device powered by batteries contained beneath the handle grip through wires contained within the shaft. An end cap is removably placeable over a battery chamber opening at the upper end of the handle grip. The sound producing device may be activated by a switch conveniently located on the golf head and may contain a miniature record disc having recorded therein such sounds as laughter, barking dogs, fire engine sounds, crying baby sounds, coughing, and the like.

6 Claims, 1 Drawing Sheet

NOVELTY GOLF CLUB WITH PROGRAMMED SOUND PLAYING DEVICE

BACKGROUND OF THE INVENTION

The present invention relates to a novelty golf club. In the prior art, sounding devices associated with golf clubs are known. Thus, Haas U.S. Pat. No. 3,254,895 discloses a golf training device designed to be swung by the user and including a striker designed to hit a sounding element if the golf swing is correct. A correct swing will result in an audible sound. Further, Jett U.S. Pat. No. 3,762,720 discloses the concept of a training device designed to warn a golfer by means of an audible signal that the strength of his grip on the golf club shaft has fallen below a desired level. The device includes a switch incorporated in the area of the grip which when sufficiently released causes a circuit to close to thereby cause a buzzer to sound.

Furthermore, the concept of sounding devices incorporated in diverse art devices is known. Katz et al. U.S. Pat. No. 2,657,607, discloses a pocketbook having a music box incorporated therein which may be activated responsive to opening of the pocketbook.

However, applicant is aware of no prior art teaching the concept of incorporating a sound device in a golf club in the manner disclosed herein.

SUMMARY OF THE INVENTION

The present invention is distinct from the teachings of the above discussed United States patents as including a novelty purpose. In particular, it is the intent of the present invention that the inventive sound producing device be activated in a manner designed to evoke laughter from anyone who hears the program which is played by the sound producing device. The present invention includes the following interrelated aspects and features:

(a) In a first aspect, the inventive device is made to resemble a golf club in all its detail, however, the inventive device is never intended to be utilized as a golf club since it is made of materials not designed to withstand the forces generated when a club is swung and the head strikes a golf ball. In this regard, the device may have a housing made to resemble a golf club including the head, shaft and grip area which device may be made of a molded material such as for example plastic.

(b) The head portion of the club is hollow and has contained therein a sound producing device which may be of a well known design including a miniature record disk played by a needle mechanism and which device is battery operated. The sound producing device may be selectively activated through operation of an on-off switch.

(c) Due to size restrictions, the batteries which power the sound producing device may not be located in the club head. As such, in the present invention, the proximal end of the shaft in the grip area includes a battery compartment including a removable cap allowing access thereto. Electrical conductors are provided which extend down the golf shaft to the club head hollowed area to interconnect with the sound producing device and provide power thereto. In the preferred embodiment, the actuator switch is located on the exterior of the club head.

As such, it is a first object of the present invention to provide a new novelty golf club.

It is a further object of the present invention to provide a novelty golf club made to resemble a golf club in every respect but not usable as an actual golf club to strike a golf ball.

It is a further object of the present invention to provide such a device including a selectively actuable sound producing device contained within the club head thereof.

It is yet a further object of the present invention to provide such a device wherein the batteries which power the sound producing device are located at the proximal end of the shaft in the grip area thereof.

These and other objects, aspects and features will be better understood from the following detailed description of the preferred embodiment when read in conjunction with the appended drawing figures.

SPECIFIC DESCRIPTION OF THE PREFERRED EMBODIMENTS

Figures 1, 2:
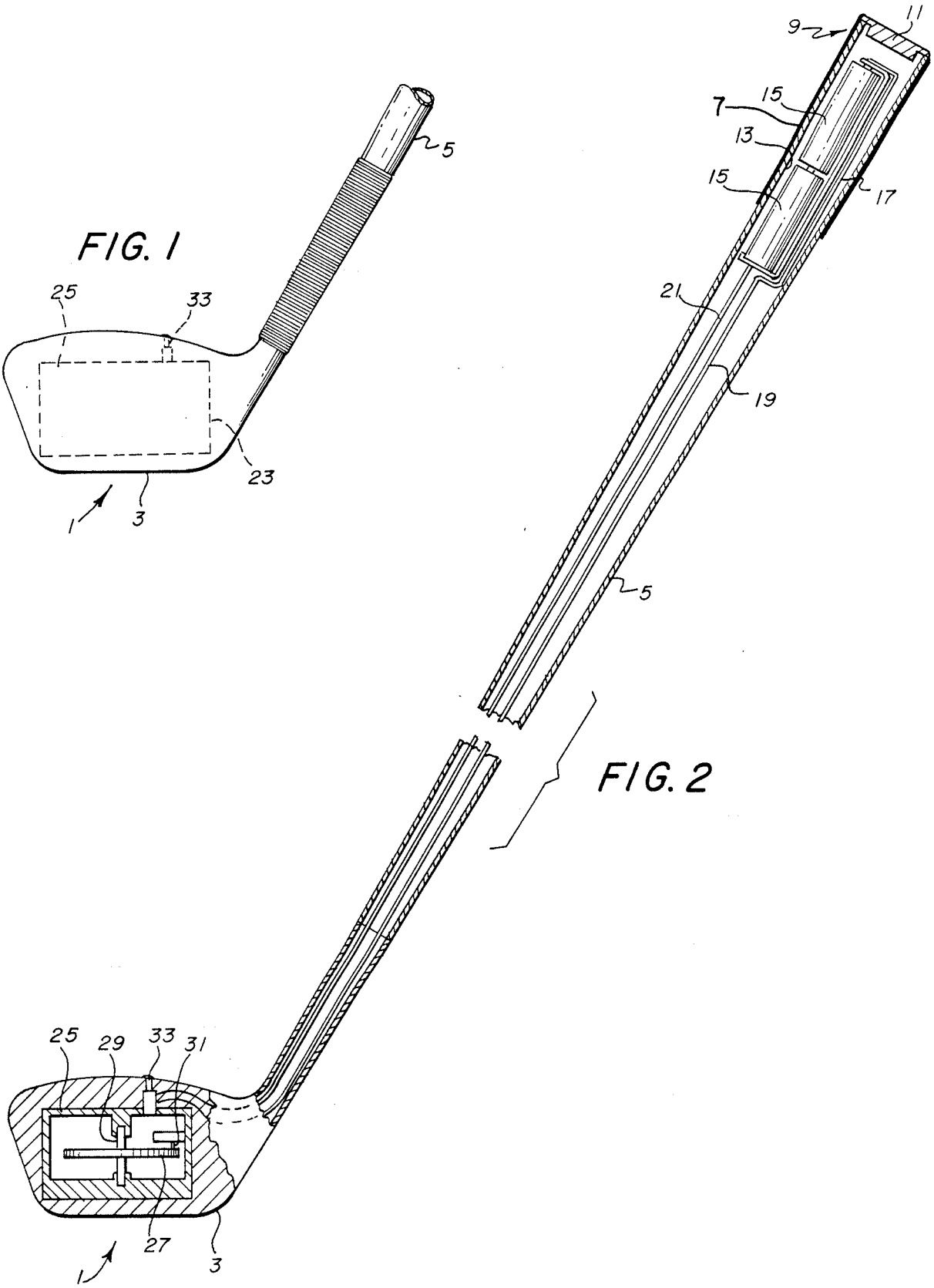
FIG. 1 shows an enlarged side view, partially in cross section, of the club head and distal shaft end of the present invention.
FIG. 2 shows a further side view partially in cross section of the entirety of the inventive device.

With reference first to FIG. 2, the inventive device is generally designated by the reference numeral 1 and includes a club head portion 3, an elongated shaft 5, a grip area 7 and a proximal end 9 having a cap 11 detachably connected thereto and which closes an elongated battery chamber 13. Contained within the chamber 13, in the preferred embodiment, are two batteries 15 which are connected in series on an electrical bracket 17. Electrical conductors 19, 21 are electrically connected to the bracket 17 and extend downwardly within the hollow shaft 5 down to the head 3 of the device 1.

With reference to FIG. 1, it is seen that the head 3 is hollow and includes an internal chamber 23 having mounted therein a sound producing device 25 best seen in FIG. 2 to include a disk 27 mounted on a spindle 29 so as to rotate within the device 25, and a playing needle 31 which may be selectively placed in playing engagement on the surface of the disk 27 to play the pre-recorded message contained therein.

With reference back to FIG. 1, it is seen that an elongated pin 33 protrudes outwardly from the head 3 of the device 1 and may selectively reciprocated to actuate the sound producing mechanism contained within the device 25. The device 25 in and of itself is a well known device and devices similar to that which is depicted by the reference numeral 25 in this patent application have been utilized for example, in toys wherein an actuator such as a string or other implement is utilized to activate the sound reproducing device contained therein.

As should be understood, the device 25 is powered by the batteries 15 and is activted responsive to operation of the pin 33. When it is desired to cause the device 25 to play the pre-recorded program, the pin 33 is reciprocated thereby resulting in commencement of rotation of the disk 27 and placement of the needle 31 on the playing surface thereof.

In the preferred embodiment, the program which is prerecorded on the disk 27 may be any program which, in the environment of an artificial golf club would best evoke laughter among those persons adjacent the device when it is activated. Examples of programs which may be pre-recorded on the disk 27 include but are not limited to laughter, barking dogs, fire engine sounds, crying baby sounds, coughing sounds and the like.

The present invention is intended to be used by placing the device 1 within a golf bag (not shown) which contains a plurality of golf clubs all of which, except for the device 1, are actually usable to strike a golf ball. When it is desired to evoke laughter from participants in a golf game, the device 1 is removed from the golf bag and at the opportune moment, the sound producing device 25 is activated to thereby evoke laughter from the participants in the golf game.

Of course, variations in the teachings of the present invention may be contemplated by those skilled in the art without departing from the intended spirit and scope thereof. Thus, for example, the batteries may be contained in the golf club head provided technology exists for miniaturizing the batteries and sound producing device sufficiently to enable them to be concurrently installed in the golf club head while maintaining the golf club head of the appropriate proportionate size. Furthermore, the sound producing device 25 may be embodied in a miniature tape player, miniature laser disk player, miniature wireless radio receiver or any other desired sound producing device. Accordingly, it is intended that the present invention only be limited by the terms of the appended claims.

I claim:

1. A novelty device made to resemble a golf club comprising:

(a) a club head, an elongated shaft connected to said club head and a handle connected to an end of said elongated shaft remote from said club head;

(b) a hollow chamber formed in said club head and having mounted therein a sound producing device programmed to play a novelty program;

(c) said sound producing device being battery powered;

(d) said handle being hollow and having contained therein a battery chamber adapted to contain battery means for powering said sound producing device, said battery chamber opening at an end of said handle and further including a cap removably placeable over said opening; and (e) electrical conductors extending within said elongated shaft between said battery chamber and said hollow chamber for electrically interconnecting said battery means with said sound producing device.

2. The invention of claim 1, further including switch means on said club head for activating said sound producing device.

3. The invention of claim 1, wherein said sound producing device includes a record disk having prerecorded thereon a pre-determined said novelty program.

4. The invention of claim 3, wherein said pre-determined novelty program consists of laughter.

5. The invention of claim 3, wherein said pre-determined novelty program comprises the sound of a barking dog.

6. The invention of claim 3, wherein said pre-determined novelty program comprises the sound of a crying baby.

* * * * *